United States Patent [19]

Yoshiba et al.

[11] 4,387,694

[45] Jun. 14, 1983

[54] EGR CONTROL SYSTEM FOR DIESEL ENGINE

[75] Inventors: Yasutaka Yoshiba, Chiba; Masaji Shiobara, Chigasaki, both of Japan

[73] Assignee: Nissan Motor Co., Ltd., Yokohama, Japan

[21] Appl. No.: 262,788

[22] Filed: May 11, 1981

[30] Foreign Application Priority Data

May 12, 1980 [JP] Japan ..... 55-61676

[51] Int. Cl.[3] ..... F02M 25/06

[52] U.S. Cl. ..... 123/571; 123/569

[58] Field of Search ..... 123/568, 569, 571

[56] References Cited

U.S. PATENT DOCUMENTS

| | | | |
|---|---|---|---|
| 3,800,764 | 4/1974 | Goto et al. . | |
| 4,018,198 | 4/1977 | Williams . | |
| 4,157,081 | 6/1979 | Wake et al. | 123/569 |
| 4,157,081 | 6/1979 | Wake et al. . | |
| 4,164,208 | 8/1979 | Okitsu et al. . | |
| 4,223,356 | 9/1980 | Uedo et al. . | |
| 4,300,515 | 11/1981 | Straubel et al. | 123/569 |

FOREIGN PATENT DOCUMENTS

| | | | |
|---|---|---|---|
| 2851180 | of 0000 | Fed. Rep. of Germany . | |
| 3023181 | of 0000 | Fed. Rep. of Germany . | |
| 2063997 | 6/1981 | United Kingdom | 123/568 |

*Primary Examiner*—Wendell E. Burns

*Attorney, Agent, or Firm*—Lowe, King, Price & Becker

[57] ABSTRACT

An EGR control system for a diesel engine, comprises an EGR passageway connecting an intake passageway and an exhaust passageway to recirculate engine exhaust gas back to the engine, an EGR control valve operatively disposed in the EGR passageway to control the flow of the recirculated exhaust gas passing through the EGR passageway, a detecting device for detecting at least one of engine speed, engine load and engine coolant temperature to produce at least a signal dependent thereon, and a control device for controlling the operation of the EGR control valve in response to the signal from the detecting device, thereby controlling the amount of the recirculated exhaust gas in accordance with engine operating conditions.

12 Claims, 2 Drawing Figures

EGR CONTROL SYSTEM FOR DIESEL ENGINE

BACKGROUND OF THE INVENTION

This invention relates to an exhaust gas recirculation (referred hereinafter to as "EGR") control system for a diesel engine, and more particularly to an improvement in an EGR control system to optimize both NOx (nitrogen oxides) emission control and engine driveability.

Many modern internal combustion engines are equipped with EGR control systems in which a part of an engines exhaust gas is recirculated back to the engine to suppress a rise in combustion temperature in the combustion chambers of the engine so as to lower NOx emission from the engine. In such engines, it is required to control quantities EGR gas to optimize both NOx emission decreasing effect and engine driveability. The optimal quantity of EGR gas usually depends on the pressure differential between intake air and exhaust gas and on the opening area of an EGR passageway connecting intake and exhaust passageways.

In diesel engines, a throttle valve is provided to generate intake vacuum necessary for EGR, in which the throttle valve is operated in relation to a fuel control lever of a fuel injection pump which control lever is moved by an accelerator. However, with this arrangement, an increased accelerator operation effort is unavoidably required; and since the displacement of the fuel control lever or fuel injection amount is greater at a low engine speed and high engine load operation range, EGR further deteriorates combustion in the engine, thereby increasing emission of black smoke. Otherwise, there is a device for hydraulically controlling the throttle valve without connection with the accelerator. Even with this device, however, the problem of increased black smoke emission has not been solved.

BRIEF SUMMARY OF THE INVENTION

According to the present invention, an EGR control system for a diesel engine comprises an EGR passageway connecting an intake passageway and an exhaust passageway to recirculate engine exhaust gas back to the engine, and an EGR control valve operatively disposed in the EGR passageway to control the flow of the recirculated exhaust gas passing through the EGR passageway. The EGR control system is further equipped with a detecting device for detecting at least one of engine speed, engine load and engine coolant temperature to generate at least a signal dependent thereof, and with a control device for controlling the operation of the EGR control valve in response to the signal from the detecting device so as to control the amount of the recirculated exhaust gas in accordance with engine operating conditions.

With this arrangement, the amount of EGR gas can be controlled precisely, in an optimum amount suitable for engine characteristics at an engine operating range where EGR is necessary to decrease NOx emission level without causing black smoke emission, and EGR is positively cut off to greatly improve engine stability and driveability at an engine operating range where EGR is unnecessary.

BRIEF DESCRIPTION OF THE DRAWINGS

The features and advantages of the EGR control system according to the present invention will be more clearly appreciated from the following description taken in conjunction with the accompanying drawings in which like reference numerals designate like parts and elements, and in which.

DETAILED DESCRIPTION OF THE INVENTION

Figure 1:
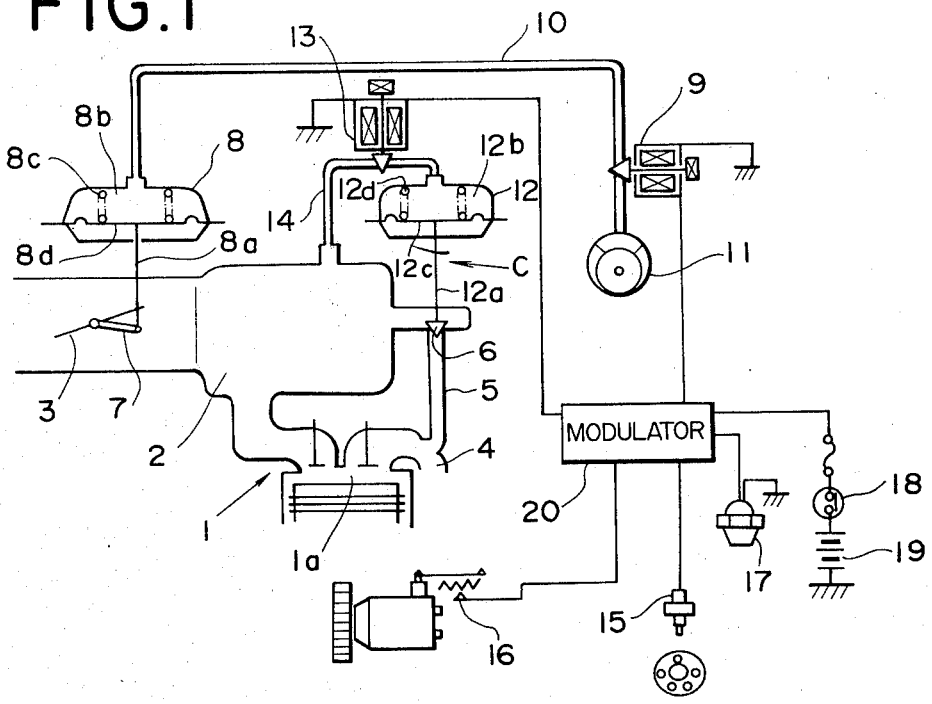
FIG. 1 is a schematic illustration of an embodiment of an EGR control system in accordance with the present invention.

Referring now to FIG. 1 of the drawings, there is shown an embodiment of an EGR (Exhaust Gas Recirculation) control system for a Diesel engine 1 which is provided with an intake passageway 2 and an exhaust passageway 4. The intake passageway 2 provides communication between ambient air and a combustion chamber 1*a* (or combustion chambers) of the engine 1 to induct atmospheric air therethrough into the combustion chamber. The exhaust gas passageway provides communication between the combustion chamber 1*a* and ambient air to discharge engine exhaust gas to ambient air.

A throttle valve 3 is pivotally disposed within the intake passageway 2 to control the amount of air flow to the combustion chamber 1*a*. The throttle valve 3 is connected through a lever 7 to a rod 8*a* of a diaphragm actuator 8. The diaphragm actuator 8 is provided with a diaphragm member 8*d* which defines a vacuum operating chamber 8*b* and is biased downward in the drawing by a spring 8*c*. The rod 8*a* is secured to the diaphragm member 8*d*. The vacuum operating chamber 8*b* communicates through a vacuum passage 10 with a vacuum pump 11, so that the vacuum chamber 8*b* of the actuator 8 can be supplied with vacuum from the vacuum pump 11. An electromagnetic valve 9 is provided to open or close the vacuum passage 10. Accordingly, when the valve 9 opens or operates to open the vacuum passage 10, the vacuum from the vacuum pump 11 is supplied to the vacuum operation chamber 8*b* of the actuator 8, so that the actuator rod 8*a* moves upward against the bias of the spring 8*c* to allow the throttle valve 3 to close. It will be understood that although the throttle valve 3 is closed, some degree of opening is maintained to obtain a necessary amount of intake air to be supplied to the engine 1. On the contrary, when the valve 9 operates to close the vacuum passage 10, the vacuum operating chamber 8*b* is communicated with a relief or bleed port (not shown) of the electromagnetic valve 9 to induct atmospheric air into the vacuum operating chamber 8*b*, so that the rod 8*a* is maintained at its descent position by the biasing force of the spring 8*c*, causing the throttle valve to remain opened.

An EGR control valve assembly C is provided to control the amount of engine exhaust gas recirculated back to the engine combustion chamber 1*a* via the EGR and intake passageways 5 and 2. The control valve assembly C includes a valve head 6 which closes or opens the exhaust passageway 5. The valve head 6 is securely attached to the lower end of a rod 12*a* which is secured to a diaphragm member 12*c* of a diaphragm actuator 12. The diaphragm member 12*c* is biased by a spring 12*d* so as to allow the valve head 6 to close the EGR passageway 5. The diaphragm member 12*d* defines a vacuum operating chamber 12*b* which communicates through a vacuum passage 14 with the intake passageway 2 downstream of the throttle valve 3. The vacuum operating chamber 12*b* may communicate through the vacuum passage 14 with the vacuum passage 10, as will be shown in FIG. 2. An electromagnetic valve 13 is provided to open or close the vacuum passage 14. When the valve 13 opens or operates to open the vacuum passage 14, intake vacuum prevailing in the intake passageway 2 downstream of the throttle valve 3 is introduced via the vacuum passage 14 to the vacuum operating chamber 12*b*, so that the actuator rod 12*a* is withdrawn or moves upward in the drawing to open the EGR control valve C, thereby opening the EGR passageway 5. On the contrary, when the valve 13 closes or operates to close the vacuum passage 14, the vacuum operating chamber 12*b* of the actuator 12 is communicated with a relief or bleed port (not shown) of the electromagnetic valve 13 so as to supply the chamber 12*b* with atmospheric air. Accordingly, the valve head 6 closes the EGR passageway 5 by the biasing force of the spring 12*d*.

Additionally, an engine speed sensor 15 is provided to generate an electric signal upon detecting the rotational speed of a pulley (not shown) for driving a fuel injection pump or a flywheel (not shown), or detecting the injection pressure pulsation of the fuel injection pump. An engine load sensor 16 is provided to generate an electric signal upon detecting, using a potentiometer or the like, the location of a fuel amount control lever in case of an inline fuel injection pump or the location of a fuel control (metering) sleeve in case of a distributor type fuel injection pump. An engine coolant temperature sensor 17 is provided to generate an electric signal upon detecting the temperature of engine coolant. The engine speed sensor 15, the engine load sensor 16 and the engine coolant temperature sensor 17 are electrically connected to the input terminals of a modulator 20 or control circuit which is electrically connected through an ignition switch 18 with an electric source 19. The output terminals of the modulator 20 are electrically connected to the two electromagnetic valves 9 and 13, respectively. The modulator 20 is constructed and arranged to control the output therefrom by means of a comparator contained therein upon receiving the inputs or the electric signals from the above-mentioned various sensors 15, 16 and 17.

The manner of operation of the EGR control system will be illustrated hereinafter.

After completion of warm-up operation of the engine in which the engine coolant temperature has reached a predetermined level, for example, higher than 50° C., the above-mentioned sensors 15, 16 and 17 detect an engine operating condition in which the engine speed is lower than a predetermined high level and the engine load is lower than a predetermined level, the modulator 20 reads the engine operating condition as an exhaust gas recirculation required condition, and therefore generates the electric signal or an output voltage at the output terminals thereof connected to the electromagnetic valves 9 and 13. As a result, the electromagnetic valves 9 and 13 are supplied with the electric signal from the modulator 20 so that both valves 9 and 13 open, and consequently the vacuum operating chambers 8*b* and 12*b* of the actuators 8 and 12 are supplied with vacuum from the vacuum pump 11 and engine intake vacuum from the intake passageway 2, respectively. This causes the throttle valve 3 to close and the EGR control valve C to open. Accordingly, engine exhaust gas is effectively introduced through the EGR passageway 5 to the intake passageway 2 in accordance with the pressure differential between exhaust pressure and engine intake vacuum prevailing in the intake passageway 2 downstream of the throttle valve 3, so that exhaust gas recirculation back to the combustion chamber 1*a* is carried out, thereby effectively decreasing NOx emission under the above-mentioned engine operating condition.

When the engine operates under conditions other than the above, i.e., an engine operation range where NOx emission is less or an engine operation range where combustion in the engine deteriorates and good engine stability and driveability are required, the sensors 15, 16 and 17 generate the electric signals representative of the engine operating condition and supply them to the modulator 20. Then, the modulator 20 makes the output voltage zero level, by which both the electromagnetic valves 9 and 13 remain closed. As a result, the throttle valve 3 remains opened and the EGR control valve 6 remains closed, and therefore exhaust gas recirculation is not carried out, thereby improving engine stability and driveability.

It will be understood that the relationship between the open-close action of the throttle valve 3 and the vacuum supply-interruption to the vacuum operating chamber 8*b* of the actuator 8 may be arranged to be reversed relative to the above-mentioned manner. However, the above-mentioned manner is preferable from a stand-point of improving engine starting under low temperature condition. This preference may be appreciated in that, assuming that the reversed manner relative to the above-mentioned is employed in which the throttle valve 3 is arranged to open when the vacuum is supplied to the vacuum operating chamber 8*b* of the actuator 8, the throttle valve 3 cannot fully open since the rotational speed of the vacuum pump 11 has not yet been lowered so that a sufficient vacuum cannot be obtained. This lowers intake charging efficiency, the pressure and temperature of compressed air within engine cylinders, thereby deteriorating engine starting.

Additionally, the vacuum operating chamber 12*b* of the actuator 12 may be connected with the vacuum pump 11. It will be appreciated that the variation of intake air pressure may become so great as to cause a considerable variation in engine operating condition upon simultaneous closing of the throttle valve 3 and opening of the EGR control valve 6 by simultaneously opening the both electromagnetic valves 9 and 13. To avoid such consequences, the modulator 20 may be so arranged as to generate output voltages at its two output terminals with a time lag therebetween, the terminals being connected to the electromagnetic valves 9 and 13, respectively.

Furthermore, it will be understood that the engine operation ranges where exhaust gas recirculation is carried out may not be limited to the above and therefore be set freely by varying the interior circuit of the modulator 20. Accordingly, it is possible to set an optimum exhaust gas recirculation condition, taking account of both exhaust emission control and engine driveability, so that even under engine operating condition where exhaust gas recirculation is carried out, the amount of the recirculated exhaust gas may be lessened, or exhaust gas recirculation rate is lowered by opening EGR control valve 6 allowing the throttle valve to remain opened.

Although the engine coolant temperature sensor 17 is employed to contribute to cut off exhaust gas recirculation in order to obtain stable idling of the engine and to decrease black smoke emission before completion of warm-up operation of the engine, the engine coolant temperature sensor 17 may be omitted unless the exhaust gas recirculation greatly affect engine idling and smoke emission. In other words, it is advisable not to cut off exhaust gas recirculation for the following reason: (1) Exhaust gas recirculation under low engine temperature condition leads to slow burn of the charge in the combustion chamber, thereby decreasing engine noise level; and (2) Supplying hot EGR gas causes intake air temperature to rise, thereby improving cold start of the engine. With this arrangement, in order to close the throttle valve 3 during cold start so as to positively increase EGR gas amount, the throttle valve 3 should be arranged to open during the opening period of the electromagnetic valve 9 and should be arranged to close during the closing period of the electromagnetic valve 9. This arrangement is desirable since the vacuum from the vacuum pump 11 has still been lower during low engine speed operating condition as discussed above.

Moreover, it will be understood that the electromagnetic valve 9 disposed in the vacuum passage 10 may be a so-called duty or proportional type electromagnetic valve which is constructed and arranged to control the valve opening degree thereof in accordance with, or in proportion to, the control output voltage supplied from the modulator 20. With this type of electromagnetic valve like the valve 9, the vacuum introduced to the vacuum operating chamber **8*b* of the actuator 8 is so controlled as to variably regulate the opening degree of the throttle valve 3**. Accordingly, it will become possible to increase the amount of EGR gas at an engine operating range wherein NOx emission is particularly high, thereby improving the NOx emission reduction effect at the same engine operating range. This allows exhaust gas recirculation to take place immediately near the smoke limit, thereby achieving NOx emission decreasing throughout a wide range of engine operation.

Figure 2:
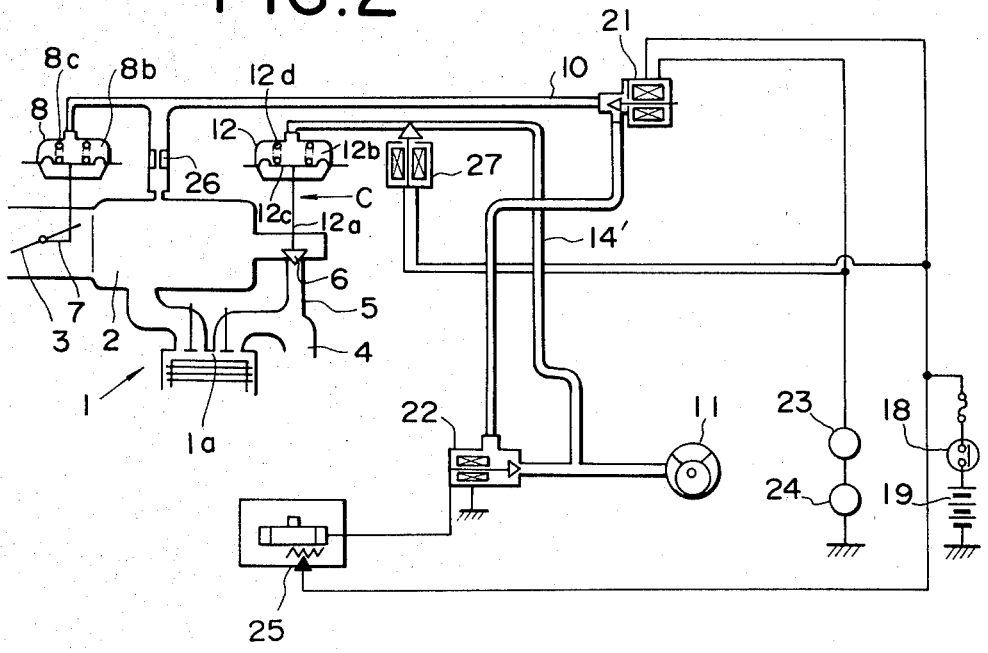
FIG. 2 is a schematic illustration of another embodiment of the EGR control system in accordance with the present invention.

FIG. 2 illustrates another embodiment of the EGR control system. In this embodiment, the vacuum passage 10 connecting the vacuum chamber **8*b* of the diaphragm actuator 8 and the vacuum pump 11 is provided with an electromagnetic valve 21 of a so-called ON-OFF type wherein the valve operates in an ON-OFF manner and an electromagnetic valve of the duty or proportional type. The electromagnetic valve 21 is electrically connected to an engine speed switch 23 which turns ON when the engine speed is below a predetermined level, an engine coolant temperature switch 24 which turns ON when engine coolant temperature is above a predetermined level, and the electric source 19 through the ignition switch connected in series. The electromagnetic valve 22 is electrically connected to an engine load sensor 25 of a potentiometer type wherein the resistance value varies in response to the location of a fuel control (metering) sleeve of a distributor type fuel injection pump, and the electric source 19 through the ignition switch 18, in which the opening degree of the electromagnetic valve 22 decreases in accordance with increase in fuel injection amount so that the electromagnetic valve 22 fully closes upon a fuel injection amount above a predetermined level. The vacuum passage 10 is branched from between the actuator 8 and the electromagnetic valve 21 and connected to the intake passageway 2 downstream of the throttle valve 3 through a restriction orifice 26. The vacuum operating chamber 12*b* of the diaphragm actuator 12 is connected to the vacuum pump 11 through the vacuum passage 14' in which an electromagnetic valve 27 of the ON-OFF type is operatively disposed. The electromagnetic valve 27 is electrically connected to the electric source 19 in parallel with the electromagnetic valve 21**.

In operation of the arrangement of FIG. 2, when the engine speed is lower than the predetermined level and the engine coolant temperature is higher than the predetermined level, the engine speed switch 22 and the engine coolant temperature switch 24 respectively turn ON to pass electric current through the electromagnetic valves 21 and 27, so that the electromagnetic valves 21 and 27 open. At this time, the vacuum chamber **8*b* of the actuator 8 is supplied with the vacuum prepared by mixing vacuum which is from the vacuum pump 11 through the electromagnetic valve 22 whose opening degree is controlled in accordance with the fuel injection amount as discussed above and an intake vaccum which is from the intake passageway 2 downstream of the throttle valve 3 through the orifice 26, in which the throttle valve 3 is so controlled that its opening degree increases with increase in the above-mentioned mixed vacuum. In this case, the opening degree of the second electromagnetic valve 22 decreases with an increase in fuel injection amount or engine load, thereby increasing the opening degree of the throttle valve 3. Particularly when the fuel injection amount is above the predetermined level, the electromagnetic valve 22 is fully closed and simultaneously the vacuum operating chamber 8*b* is communicated with the relief port of the electromagnetic valve 22 so as to communicate with ambient air. As a result, the throttle valve 3 is fully opened and accordingly the amount of EGR gas is greatly decreased upon a considerable lowering in the intake vacuum prevailing in the intake passageway 2 downstream of the throttle valve 3. Upon opening of the electromagnetic valve 27, the vacuum operating chamber 12*b* is supplied with vacuum from the vacuum pump 11 to open the EGR control valve 6**, on which exhaust gas recirculation takes place.

At an engine operation range except for the above-mentioned, at least one of the engine speed switch 23 and the engine coolant temperature switch 24 turns OFF, so that electric current supply to the electromagnetic valves 21 and 27 are interrupted. Accordingly, the introduction of vacuum to the vacuum operation chambers **8*b* and 12*b* are interrupted and therefore the throttle valve 3 fully open and the EGR control valve head 6 fully closes the EGR passageway 5**. As a result, exhaust gas recirculation is not carried out, thereby obtaining good engine stability and driveability.

Although, in this embodiment, the intake vacuum downstream of the throttle valve 3 has been shown and described to be used as a control vacuum for controlling the throttle valve 3 in addition to the vacuum from the vacuum pump 11, the control of the throttle valve by the vacuum from the vacuum pump 11 can be effectively achieved by virtue of the restriction orifice 26 located within a vacuum conduit connecting the vacuum passage 10 and the intake passageway 2 downstream of the throttle valve 3. This orifice 26 may be replaced with a kind of valve operatively disposed in the vacuum conduit connecting the vacuum passage 10 and the intake passageway 2, which valve may be arranged to open or close the vacuum conduit in accordance with engine operating conditions.

While the throttle valve has been so shown and described that its opening degree is controlled by the diaphragm actuator, it will be understood that the opening degree of the throttle valve may be controlled by an actuator of a servomotor type wherein its moving stroke is varied, for example, in response to detection signal from the engine load sensor for detecting fuel injection amount. Furthermore, while the above-mentioned embodiments have shown and described that exhaust gas recirculation is controlled under cooperation of the throttle valve and the EGR control valve C, it will be appreciated that such control of exhaust gas recirculation may be achieved only by the EGR control valve C which is, in turn, regulated in accordance with at least one of engine speed, engine load, and engine coolant temperature.

As will be appreciated from the above, according to the present invention, the EGR control valve is controlled in accordance with at least one of the engine parameters of engine speed, engine load, and engine coolant temperature. Therefore, smooth and high accuracy exhaust gas recirculation can be achieved at an engine operating range where exhaust gas recirculation suitable for operating characteristics of a diesel engine is required, and the exhaust gas recirculation can be cut off at a range of engine operation where exhaust gas recirculation is not required, thereby improving engine operation stability and driveability.

What is claimed is:

1. An EGR control system for a diesel engine having an intake passageway and an exhaust passageway, comprising:

means defining an EGR passageway interconnecting the intake and exhaust passageways to recirculate engine exhaust gas therethrough back to the engine;

an EGR control valve operatively disposed in said EGR passageway to control the flow of the recirculated exhaust gas passing through said EGR passageway, said EGR control valve including a first diaphragm actuator having a diaphragm member which defines a vacuum operating chamber, and a valve head connected to said diaphragm member and disposed in the EGR passageway so that said EGR passageway is closable with said valve head in response to the movement of said diaphragm member;

a throttle valve pivotally disposed within the intake passageway;

means for detecting at least one of engine speed, engine load and engine coolant temperature to generate at least a signal dependent thereon, said detecting means including at least one of an engine speed sensor for sensing engine speed of the engine, an engine load sensor for sensing engine load of the engine, and an engine coolant temperature sensor for sensing the temperature of engine coolant of the engine, said sensors generating respective information signals representative of an engine operating condition;

means for controlling the operation of said EGR control valve in response to the signal from said detecting means so as to control the amount of the recirculated exhaust gas in accordance with engine operating conditions, said EGR control valve operation controlling means including a modulator electrically connected to at least one of said engine speed sensor, said engine load sensor, and said engine coolant temperature sensor, said modulator being constructed and arranged to generate at least a command signal in response to at least one of said information signals supplied thereto, and a first electromagnetic valve electrically connected to said modulator to control vacuum supply to the vacuum operating chamber of said first diaphragm actuator in response to said command signal; and means for controlling the operation of said throttle valve in response to the signals from said detecting means, said throttle valve operation controlling means including a second diaphragm actuator having a diaphragm member which defines a vacuum operating chamber, said throttle valve being connected to said diaphragm member, and a second electromagnetic valve electrically connected to said modulator to control vacuum supply to the vacuum operating chamber of said second diaphragm actuator in response to said command signal.

2. An EGR control system as claimed in claim 1, wherein said EGR control valve operation controlling means further includes means defining a first passage connecting the vacuum operating chamber of said first diaphragm actuator with the intake passageway downstream of said throttle valve, said first electromagnetic valve being operatively disposed in said first passage, and said throttle valve operation controlling means includes means defining a second passage connecting the vacuum operating chamber of said second diaphragm actuator with a vacuum pump, said second electromagnetic valve being operatively disposed in said second passage.

3. A EGR control system as claimed in claim 2, wherein said modulator is constructed and arranged to supply said command signal to said first and second electromagnetic valves upon receiving said information signals representative of the engine operating condition where said engine speed is lower than a predetermined level, said engine load is lower than a predetermined level, and said engine coolant temperature is higher than a predetermined level.

4. An EGR control system as claimed in claim 3, wherein said first electromagnetic valve is constructed and arranged to open to establish fluid communication between the vacuum operating chamber of said first diaphragm actuator and the intake passageway when supplied with said command signal; and said second electromagnetic valve is constructed and arranged to open to establish fluid communication between the vacuum operating chamber of said second diaphragm actuator and said vacuum pump when supplied with said command signal.

5. An EGR control system as claimed in claim 4, wherein said EGR control valve is so constructed and arranged that its valve head moves to open said EGR passageway when the vacuum operating chamber of said first diaphragm actuator is supplied with the vacuum from the intake passageway; and said throttle valve is constructed and arranged to close when the vacuum operating chamber of said second actuator is supplied with the vacuum from said vacuum pump.

6. An EGR control system for a diesel engine having an intake passageway and an exhaust passageway, comprising:

means defining an EGR passageway interconnecting the intake and exhaust passageways to recirculate engine exhaust gas therethrough back to the engine;

an EGR control valve operatively disposed in said EGR passageway to control the flow of the recirculated exhaust gas passing through said EGR passageway, said EGR control valve including a first diaphragm actuator having a diaphragm member which defines a vacuum operating chamber, and a valve head connected to said diaphragm member and disposed in the EGR passageway so that said EGR passageway is closable with said valve head in response to the movement of said diaphragm member;

a throttle valve pivotally disposed within the intake passageway;

means for detecting at least one of engine speed, engine load and engine coolant temperature to generate at least a signal dependent thereon, said detecting means including at least one of an engine speed switch constructed and arranged to turn ON when engine speed is lower than a predetermined level, an engine coolant temperature switch constructed and arranged to turn ON when engine coolant temperature is higher than a predetermined level, and an engine load sensor for sensing engine load of the engine to generate a signal representative of an engine load;

means for controlling the operation of said EGR control valve in response to the signal from said detecting means so as to control the amount of the recirculated exhaust gas in accordance with engine operating conditions, said EGR control valve operation controlling means including a first ON-OFF type electromagnetic valve for controlling vacuum supply to the vacuum operating chamber of said first diaphragm actuator in response to the switchings of said engine speed switch and said engine temperature switch; and means for controlling the operation of said throttle valve in response to the signals from said detecting means, said throttle valve operation controlling means including a second diaphragm actuator having a diaphragm which defines a vacuum operating chamber, said throttle valve being connected to said diaphragm member, a second ON-OFF type electromagnetic valve for controlling vacuum supply to the vacuum operating chamber of said second diaphragm actuator in response to the switchings of said engine speed and engine coolant temperature switches, and a proportional type electromagnetic valve for controlling vacuum supply to the vacuum operating chamber of said second diaphragm actuator.

7. An EGR control system as claimed in claim 6, wherein said EGR control valve operation controlling means includes means defining a first passage connecting the vacuum operating chamber of said first diaphragm actuator with a vacuum pump, said first ON-OFF type electromagnetic valve being operatively disposed in said first passage; and said throttle valve operation controlling means includes means defining a second passage connecting the vacuum operating chamber of said second diaphragm actuator with said vacuum pump, said second ON-OFF type and proportional type electromagnetic valves being operatively disposed in said second passage, and means defining a third passage connecting said second passage between the second actuator and said second ON-OFF type electromagnetic valve with the intake passageway downstream of said throttle valve, said third passage having therein a restriction orifice.

8. An EGR control system as claimed in claim 7, wherein said first ON-OFF type electromagntic valve is constructed and arranged to open to establish fluid communication between the vacuum operating chamber of said first diaphragm actuator and said vacuum pump in response to the switchings of said engine speed and engine coolant temperature switches; said second ON-OFF type electromagnetic valve is constructed and arranged to open to establish fluid communication between vacuum operating chamber of said second diaphragm actuator with said vacuum pump in response to the switching of said engine speed and engine coolant temperature switches; and said proportional type electromagnetic valve is so constructed and arranged that the opening degree thereof decreases with increase in engine load to control the fluid communication between the vacuum operating chamber of said second diaphragm actuator and said vacuum pump.

9. An EGR control system as claimed in claim 8, wherein said EGR control valve is so constructed and arranged that its valve head moves to open said EGR passageway when the vacuum operating chamber is supplied with the vacuum from said vacuum pump; and said throttle valve is constructed and arranged to close when the vacuum operating chamber of said second diaphragm actuator is supplied with the vacuum from said vacuum pump, the opening degree of said throttle valve being controlled in accordance with the opening degree of said proportional type electromagnetic valve.

10. An EGR control system as claimed in claim 9, said engine speed and engine coolant temperature switches are connected in series with each other, and said engine load sensor is connected in parallel with said engine speed and engine coolant temperature switches.

11. An EGR control system as claimed in claim 10, wherein said proportional type electromagnetic valve is operatively disposed in said second passage between the second ON-OFF type electromagnetic valve and said vacuum pump.

12. An EGR control system for a diesel engine having an intake passageway and an exhaust passageway, comprising:

means defining an EGR passageway interconnecting the intake and exhaust passageways to recirculate engine exhaust gas therethrough back to the engine;

an EGR control valve operatively disposed in said EGR passageway to control the flow of the recirculated exhaust gas passing through said EGR passageway, said EGR control valve including a first diaphragm actuator having a diaphragm member which defines a vacuum operating chamber, and a valve head connected to said diaphragm member and disposed in the EGR passageway so that said EGR passageway is closable with said valve head in response to the movement of said diaphragm member;

a throttle valve pivotally disposed within the intake passageway;

means for detecting at least one of engine speed, engine load and engine coolant temperature to generate at least a signal dependent thereon, said detecting means including at least one of an engine speed sensor for sensing engine speed of the engine, an engine load sensor for sensing engine load of the engine, and an engine coolant temperature sensor for sensing the temperature of engine coolant of the engine, said sensors generating respective information signals representative of an engine operating condition;

means for controlling the operation of said EGR control valve in response to the signal from said detecting means so as to control the amount of the recirculated exhaust gas in accordance with engine operating conditions, said EGR control valve operating controlling means including means for generating a command signal in response to at least one of said information signals supplied thereto, and a first electromagnetic valve electrically connected to control vacuum supply to the vacuum operating chamber of said first diaphragm actuator in response to said command signal; and means for controlling the operation of said throttle valve in response to the signals from said detecting means, said throttle valve operation controlling means including a second diaphragm actuator having a diaphragm member which defines a vacuum operating chamber, said throttle valve being connected to said diaphragm member, and a second electromagnetic valve electrically connected to said modulator to control vacuum supply to the vacuum operating chamber of said second diaphragm actuator in response to said command signal, said first electromagnetic valve being constructed and arranged to open to establish fluid communication between the vacuum operating chamber of said first diaphragm actuator and the intake passageway when supplied with said command signal;

said second electromagnetic valve being constructed and arranged to open to establish fluid communication between the vacuum operating chamber of said second diaphragm actuator and said vacuum pump when supplied with said command signal.

* * * * *